US011590515B2

(12) United States Patent
Scherer

(10) Patent No.: US 11,590,515 B2
(45) Date of Patent: Feb. 28, 2023

(54) PUSHER CENTRIFUGE WITH DIRECT DRIVE TRANSMISSION

(71) Applicant: ANDRITZ KMPT GmbH, Vierkirchen (DE)

(72) Inventor: Dieter Scherer, Pfaffenhofen (DE)

(73) Assignee: ANDRITZ KMPT GmbH, Vierkirchen (DE)

( * ) Notice: Subject to any disclaimer, the term of this patent is extended or adjusted under 35 U.S.C. 154(b) by 288 days.

(21) Appl. No.: 16/916,378

(22) Filed: Jun. 30, 2020

(65) Prior Publication Data

US 2021/0001353 A1 Jan. 7, 2021

(30) Foreign Application Priority Data

Jul. 1, 2019 (DE) ..... 10 2019 117 721.9

(51) Int. Cl.
*B04B 9/04* (2006.01)
*B04B 3/02* (2006.01)
*B04B 9/08* (2006.01)

(52) U.S. Cl.
CPC ..... *B04B 9/04* (2013.01); *B04B 3/02* (2013.01); *B04B 9/08* (2013.01)

(58) Field of Classification Search
CPC ..... B04B 9/04; B04B 3/02; B04B 9/08
See application file for complete search history.

(56) References Cited

U.S. PATENT DOCUMENTS 3,136,721 A 6/1964 Gooch
4,381,236 A 4/1983 Cox
4,944,874 A * 7/1990 Kobayashi ..... B01D 33/11 209/288
5,085,443 A * 2/1992 Richards ..... F26B 5/08 277/944

(Continued)

FOREIGN PATENT DOCUMENTS

DE 10 2011 055 513 A1 5/2013
EP 2633918 A2 9/2013
GB 2076701 * 12/1981

OTHER PUBLICATIONS

European Patent Office, English abstract of DE10 2011 055 513 A1, printed on Jun. 19, 2020.

(Continued)

*Primary Examiner* — Charles Cooley
(74) *Attorney, Agent, or Firm* — Cahn & Samuels, LLP

(57) ABSTRACT

A pusher centrifuge includes a rotatable filter drum having a drum body and a piston that are configured to be reciprocated axially relative to one another, a filter drum drive shaft rigidly connected to the filter drum, a hydraulic push mechanism for generating an axial oscillating push force and connected to the filter drum so as to cause the relative reciprocating movement between the piston and the drum body, a hydraulic pump including a pump input shaft and is in fluid connection with the hydraulic push mechanism, and a drive motor including at least one output shaft connected to the pump input shaft and the filter drum drive shaft to (Continued)

actuate both the pump input shaft and the filter drum drive shaft. The at least one output shaft of the drive motor is connected to the pump input shaft in a manner without an intervening gearbox, thereby forming a direct drive.

20 Claims, 5 Drawing Sheets

(56) References Cited

U.S. PATENT DOCUMENTS

2021/0001353 A1* 1/2021 Scherer ..... B04B 9/04

OTHER PUBLICATIONS

European Patent Office, English abstract of EP2633918 A2, printed on Jun. 19, 2020.
Deutsches Patent—und Markenamt, Office Action for Application No. 10 2019 117 721.9, dated Apr. 29, 2020.
European Patent Office, extended Examination Search Report for EP Application No. 20175188.0-1016, Nov. 16, 2020, pp. 1-6.

* cited by examiner

PUSHER CENTRIFUGE WITH DIRECT DRIVE TRANSMISSION

CROSS-REFERENCE TO RELATED APPLICATION

The present application claims priority from German Pat. App. No. DE 10 2019 117 721.9, filed on Jul. 1, 2019, the contents of which are incorporated herein by reference.

TECHNICAL FIELD

Various aspects of this disclosure relate to pusher centrifuges.

BACKGROUND

Pusher centrifuges are used in many applications in chemistry and in the processing of raw materials. In general, in a conventional pusher centrifuge, a solid portion and a liquid portion of a solid-liquid mixture are separated from each other in a filter drum device of the pusher centrifuge by means of a rotational movement and the solid portion is moved out of the filter drum device of the pusher centrifuge by means of an axial oscillating push movement. For this purpose, a conventional pusher centrifuge generally includes two electric motors, by which the generation of the rotational movement and the generation of the axial oscillating push movement are respectively caused, wherein for this purpose a respective torque of the two electric motors is indirectly transmitted by means of a belt to the filter drum device and to a hydraulic pump, by means of which a hydraulic pressure causing the axial oscillating push movement is generated.

BRIEF DESCRIPTION OF DRAWINGS

In the following description, various aspects of the disclosure are described with reference to the following drawings.

Figure 1:
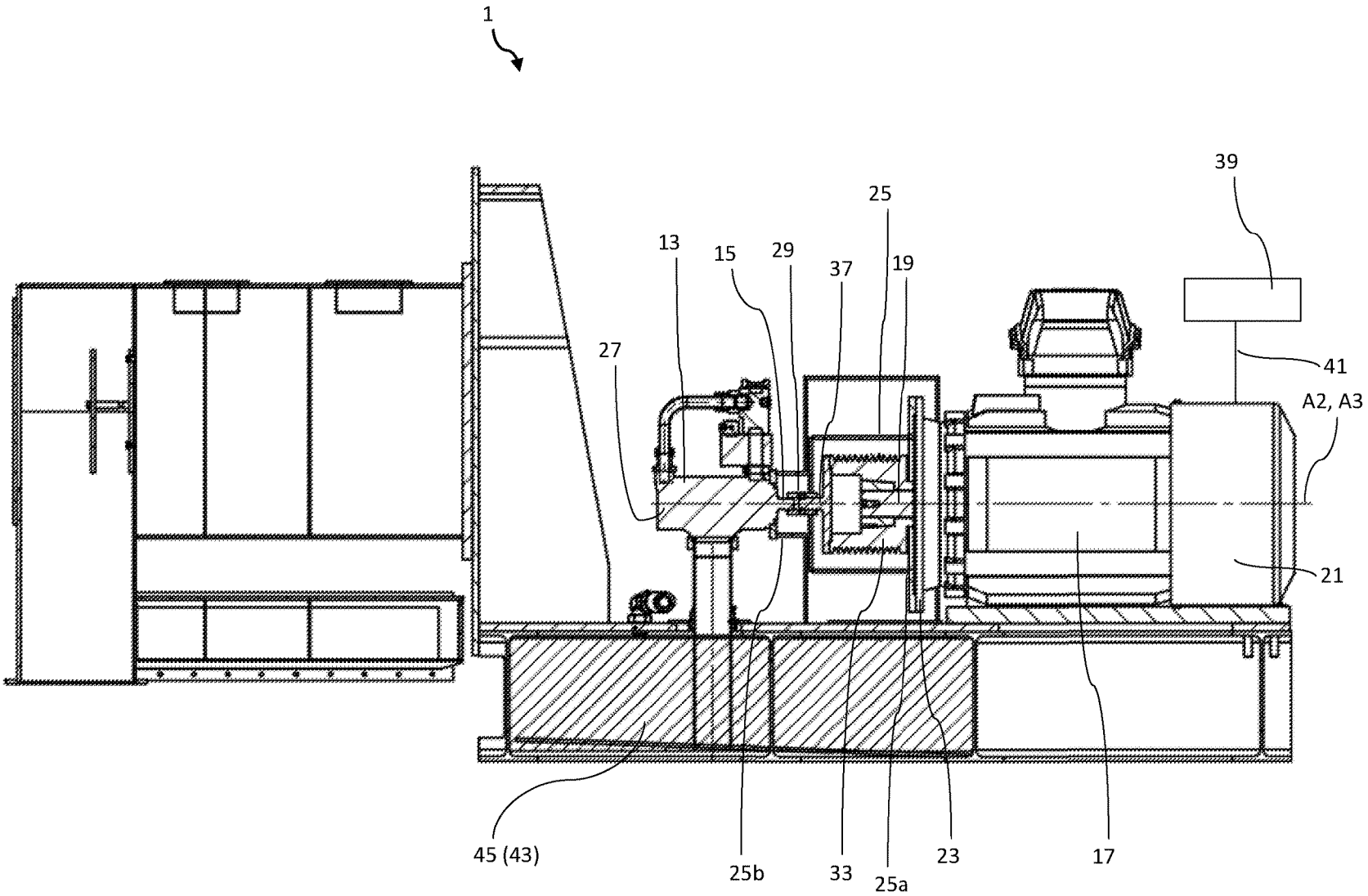
FIG. 1 schematically shows components of a pusher centrifuge according to an embodiment of the invention in a lateral partial sectional view.

Throughout the figures, identical or similar components are provided with the same reference signs.

DETAILED DESCRIPTION

The following detailed description refers to the accompanying drawings that show, by way of illustration, example details and aspects in which the disclosure may be practiced.

Various aspects of the present disclosure relate to a pusher centrifuge that is easier and less expensive to manufacture and to maintain.

The present disclosure describes a pusher centrifuge, including: a rotatable filter drum (e.g., rotatable about a filter drum longitudinal axis) having at least one drum body and having a push floor (e.g., piston) which is arranged in the filter drum, wherein the push floor and the at least one drum body are capable of being axially reciprocated relative to one another (in a longitudinal direction of the filter drum), a filter drum drive shaft (e.g., coaxial with the filter drum longitudinal axis) that is non-rotatably (e.g., rigidly and/or fixedly) connected to the filter drum (and that, for example, extends in a longitudinal direction of the filter drum) (in the present disclosure, "non-rotatably connected" means that the respective connected parts (e.g., the filter drum drive shaft and the filter drum) are connected to each other in such a manner that they are not rotatable relative to each other), a hydraulic push mechanism, for generating an axial oscillating push force (e.g., an axially oscillating axial push force), that is connected to the filter drum in such a way that the axial oscillating push force generated by the hydraulic push mechanism is transferred to the filter drum to thereby cause the relative reciprocating movement between the push floor and the drum body, a hydraulic pump for generating a hydraulic pressure including a pump input shaft and being in fluid-connection with the hydraulic push mechanism for supplying the hydraulic pressure to the hydraulic push mechanism to operate the hydraulic push mechanism to generate the axial oscillating push force, and a drive motor (e.g., a single (e.g., main) drive motor) having an output shaft connected to the pump input shaft and the filter drum drive shaft to transmit torque of the drive motor to both the pump input shaft and the filter drum drive shaft (in operation), wherein the output shaft of the drive motor is connected to the pump input shaft in a manner without an intermediate transmission conversion (e.g., without a reduction and/or change in transmission ratio (e.g., without intervening mechanical transmission conversion elements such as gearboxes or belt and pulley systems)) to thereby form a direct drive. For example, the output shaft of the drive motor is connected to the pump input shaft to directly drive the pump input shaft. For example, the output shaft of the drive motor is connected to the pump input shaft so as to be co-axially aligned with each other. For example, the output shaft of the drive motor is directly, e.g., directly co-axially, connected to the pump input shaft.

The output shaft of the drive motor may include a first output shaft and a second output shaft which, starting from the drive motor, extend from opposed (e.g., opposite) sides of the drive motor (e.g., coaxially to each other), wherein the first output shaft is connected to the pump input shaft in a manner wherein the first output shaft directly drives the pump input shaft. For example, the first output shaft is connected to the pump input shaft without an intermediate transmission conversion, e.g., without reduction and/or change in transmission ratio to thereby form a direct drive. For example, the first output shaft is co-axially or directly connected to the pump input shaft without intervening mechanical transmission elements such as gearboxes or belt and pulley systems. The second output shaft is connected to the filter drum drive shaft.

The (e.g., first) output shaft of the drive motor may be connected to the pump input shaft via a clutch.

The (e.g., second) output shaft of the drive motor may be connected to the filter drum drive shaft by a belt. The belt may be a V-belt, e.g., a ribbed V-belt, or a toothed belt. However, the (e.g., second) output shaft of the drive motor may also be connected to the filter drum drive shaft in a manner without intervening transmission elements (e.g., gearboxes or belt and pulley systems)(i.e., without an intermediate transmission conversion, e.g., without a reduction and/or change in transmission ratio) to thereby form a direct drive. In this respect, the (e.g., first) output shaft of the drive motor may be connected to the pump input shaft via a clutch as described above and the (e.g., second) output shaft of the drive motor may be connected to the filter drum drive shaft via a drive shaft clutch.

The drive motor may further include a drive pulley non-rotatably connected to the output shaft of the drive motor (as mentioned above, "non-rotatably connected" means that the drive motor and the drive pulley are connected to each other in such a manner that they are not rotatable relative to each other), and the filter drum drive shaft may further include a driven pulley, wherein the drive pulley and the driven pulley may be connected by means of a belt to connect the output shaft of the drive motor to the filter drum drive shaft. The driven pulley may be connected non-rotatably to the filter drum drive shaft or may be formed integrally (e.g., in one piece) with the filter drum drive shaft. The drive pulley may be non-rotatably connected to the output shaft of the drive motor or may be formed integrally (e.g., in one piece) with the output shaft of the drive motor.

Hydraulic pumps used in pusher centrifuges are usually available to match an electric motor that drives them, so that the motor operating speed matches the pump operating speed per se. This allows the direct drive between the drive motor and the hydraulic pump to be carried out without loss in accordance with various embodiments of the present disclosure. In contrast thereto, different rotation speeds are sometimes required for the filter drum of the pusher centrifuge depending on the matter to be centrifuged (e.g., a solid-liquid mixture to be centrifuged or a suspension to be centrifuged). Since the filter drum of the pusher centrifuge according to various embodiments of the present disclosure can be driven by the drive motor by means of a belt via respectively associated belt pulleys, a reduction or a transmission ratio between the output shaft of the drive motor and the filter drum drive shaft can be realized easily by exchanging the respective belt pulleys, so that the rotation speed can thereby be adjusted accordingly based on the requirements of a process.

The hydraulic pump, the clutch and the drive pulley (e.g., the belt looping the drive pulley) may be located on the same side of the drive motor. Starting from (e.g., starting with) the drive motor, the hydraulic pump, the clutch and the drive pulley (e.g., the belt looping the drive pulley) may be arranged in the following order: the drive pulley (or the belt), the clutch, the hydraulic pump (i.e., in the following order: the drive motor, the drive pulley (or the belt), the clutch, the hydraulic pump) along an axial direction (e.g., a longitudinal direction) of the output shaft of the drive motor. This means that along the axial direction of the output shaft of the drive motor, first the drive motor, then the drive pulley (or the belt looping the drive pulley), then the clutch and then the hydraulic pump are arranged. This may be advantageous in that the hydraulic pump requires and has only one input shaft due to its end position in this arrangement. In contrast to a hydraulic pump disposed in an intermediate position, where in addition to the input shaft of the hydraulic pump, an output shaft of the hydraulic pump is also required to transmit a torque, which leads or may lead to a more complex design including, for example, a more complex sealing device, which requires increased maintenance.

The clutch may be a non-releasable clutch. The non-releasable clutch may be a non-releasable flexible clutch (e.g., any of a jaw clutch, a denture clutch, a spring bar clutch or a cross-head clutch). The clutch may be a safety clutch, optionally a safety slip clutch. The clutch may be a safety clutch with overload protection, which has a predetermined breaking point, optionally in the form of a shear pin. The clutch may be a flexible clutch, optionally a flexible claw clutch. If the output shaft of the drive motor is connected to the pump input shaft by means of a non-releasable flexible clutch or by means of a flexible clutch, coaxial alignment differences (e.g., an axial error or an alignment error) between the output shaft of the drive motor and the pump input shaft (e.g., in operation) caused by assembly and/or manufacturing can be compensated, so that smooth operation of the hydraulic pump and the drive motor can be achieved in each case.

The output shaft of the drive motor and the pump input shaft may be at least substantially coaxial with respect to one another.

For example, the output shaft of the drive motor and the filter drum drive shaft are at least substantially parallel to each other and are not coaxial with respect to one another.

The drive motor may be an electric motor, e.g., a three-phase asynchronous motor. The electric motor may, for example, have an output of 160 kW±20% (e.g., 160 kW±10%, e.g., 160 kW±5%), but electric motors of any output may be used in the pusher centrifuge described herein, provided that their motor output is suitable for the field of application of the pusher centrifuge. The electric motor may be connected to a control device for controlling the electric motor and may be electrically connected to a power source for power supply. However, the drive motor is not limited to a motor powered by electric current. For example, the drive motor may also be designed as an internal combustion engine.

The filter drum drive shaft may include: an outer filter drum drive shaft formed as a hollow shaft, and an inner filter drum drive shaft axially movably supported in the outer filter drum drive shaft and connected to the filter drum and the hydraulic push mechanism in such a way that the axial oscillating push force is transmitted thereby from the hydraulic push mechanism to the filter drum to cause the relative reciprocating movement between the push floor and the drum body.

The relative reciprocating movement between the push floor and the drum body may be a reciprocating movement of the push floor relative to the at least one drum body (and/or vice versa). The pusher centrifuge may, for example, be multistage, the filter drum, e.g., then having several drum bodies corresponding to the number of stages, wherein the pusher centrifuge may, for example, be configured as a two-stage pusher centrifuge with an outer first drum body and an inner second drum body. The pusher centrifuge may accordingly include, e.g., a rotatable filter drum (e.g., rotatable about a filter drum longitudinal axis) having an outer first drum body and an inner second drum body and having a push floor which is arranged inside the filter drum in the inner second drum body and is fixedly (e.g., non-rotatably) connected to the outer first drum body, wherein the inner second drum body can be oscillated (or reciprocated in operation) relative to the push floor and the outer first drum body (in the longitudinal direction of the filter drum). However, the pusher centrifuge may also have three and even more stages with correspondingly three and even more drum bodies.

The inner filter drum drive shaft may be connected to the inner second drum body (e.g., non-rotatably). The outer filter drum drive shaft may be connected to the outer first drum body (e.g., non-rotatably). The push floor may be connected to the outer first drum body (e.g., non-rotatably) via rods extending axially through the inner second drum body.

The pusher centrifuge may further include: a feeding device with a feeding line via which a solid-liquid mixture to be filtered (e.g., a suspension to be filtered) can be fed into the inner second drum body and the outer first drum body (and thus into the filter drum), a solid discharge device by means of which a screened or filtered solid portion of the solid-liquid mixture can be discharged from the filter drum, and a liquid discharge device by means of which the liquid portion of the solid-liquid mixture can be discharged from the filter drum.

The example embodiments of the present disclosure described above make it possible to provide a pusher centrifuge with only one drive motor which is able to directly drive the hydraulic pump to generate a hydraulic pressure for generating the axial oscillating push force and which is able to (simultaneously) drive the filter drum, thereby being able to reduce both the manufacturing costs of the pusher centrifuge and the maintenance costs thereof. Furthermore, in contrast to conventional pusher centrifuges that have a drive motor in which two respective belts, for example, are needed to transmit a torque to a filter drum and to a hydraulic pump, the embodiments of the present disclosure do not require a second belt (and, according to an example embodiment, do not require a first and a second belt). Thus, for example, any of an associated bearing, an associated belt protection, an associated adjustment mechanism, an associated lubrication etc. is not needed (also, mechanical belt tensioning devices are not needed during maintenance work on the pusher centrifuge). As a result, the pusher centrifuge not only reduces costs, but may also have a more compact and more simple design as compared to conventional pusher centrifuges. Furthermore, another discovered advantage of the pusher centrifuge according to the present disclosure is an increased degree of efficiency compared to conventional pusher centrifuges. This efficiency advantage is attributed to the output shaft of the drive motor being connected to the pump input shaft of the hydraulic pump in a manner without an intervening transmission conversion element (e.g., gearbox), thereby forming a direct drive transmission. Furthermore, the direct drive-forming connection having no intervening transmission conversion element (e.g., gearbox) may reduce and/or avoid transverse forces, which may be generated by a belt drive and which may act on the hydraulic pump via the input shaft thereof, so that the pusher centrifuge according to the present disclosure may include a hydraulic system (i.e., the hydraulic pump, the hydraulic push mechanism fluid-connected thereto, etc.) which is more reliable in terms of operation with an increased service life. In addition, the installation effort and the installation costs of a pusher centrifuge may be reduced by means of the pusher centrifuge according to the present disclosure, since an electrical infrastructure (i.e., power supply wiring, safety boxes, etc.) is required for only one electric motor.

Figure 2:
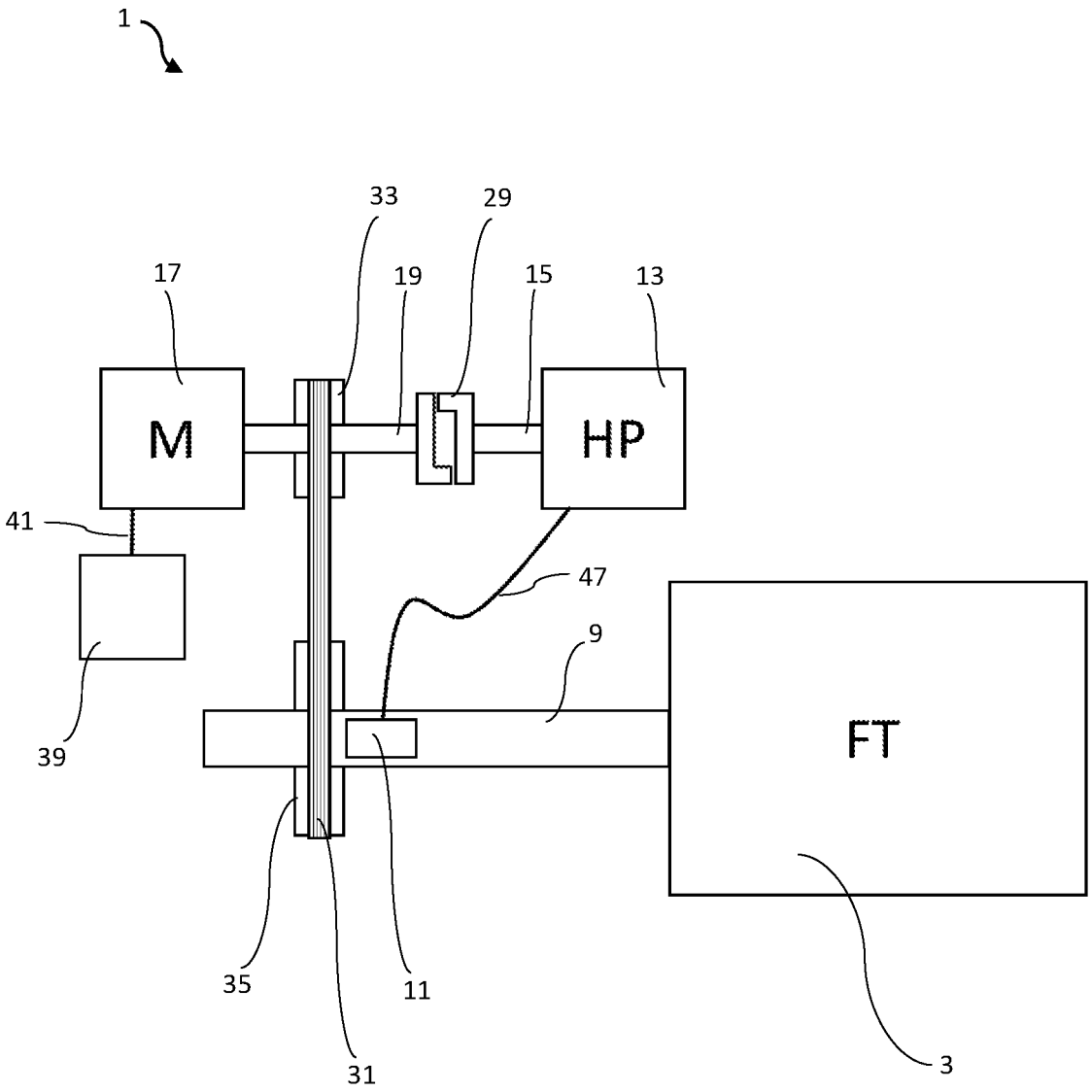
FIG. 2 shows a schematic arrangement of components of a pusher centrifuge according to an embodiment of the invention.
Figure 3:
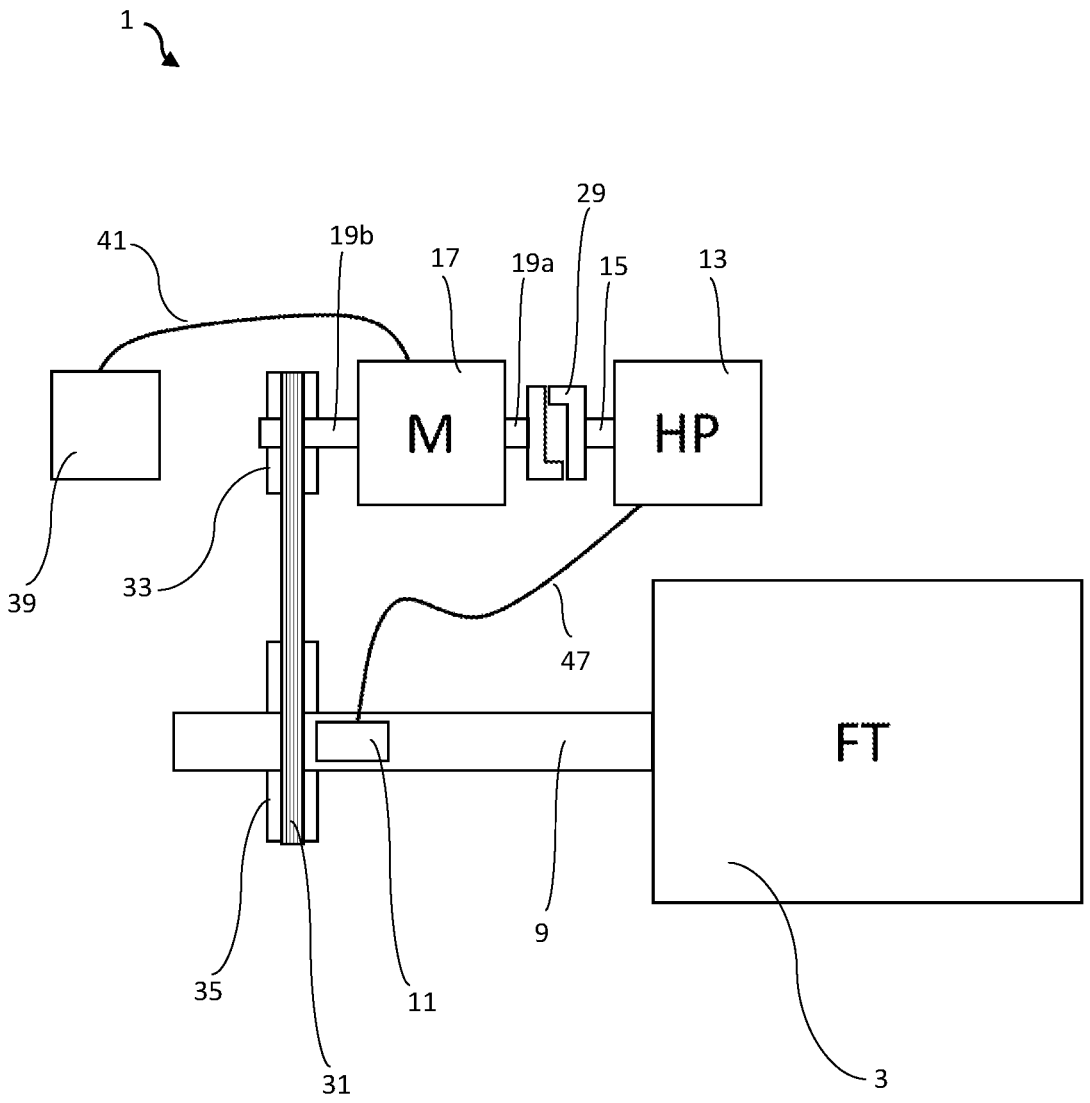
FIG. 3 shows a schematic arrangement of components of a pusher centrifuge according to an embodiment of the invention.
Figure 4:
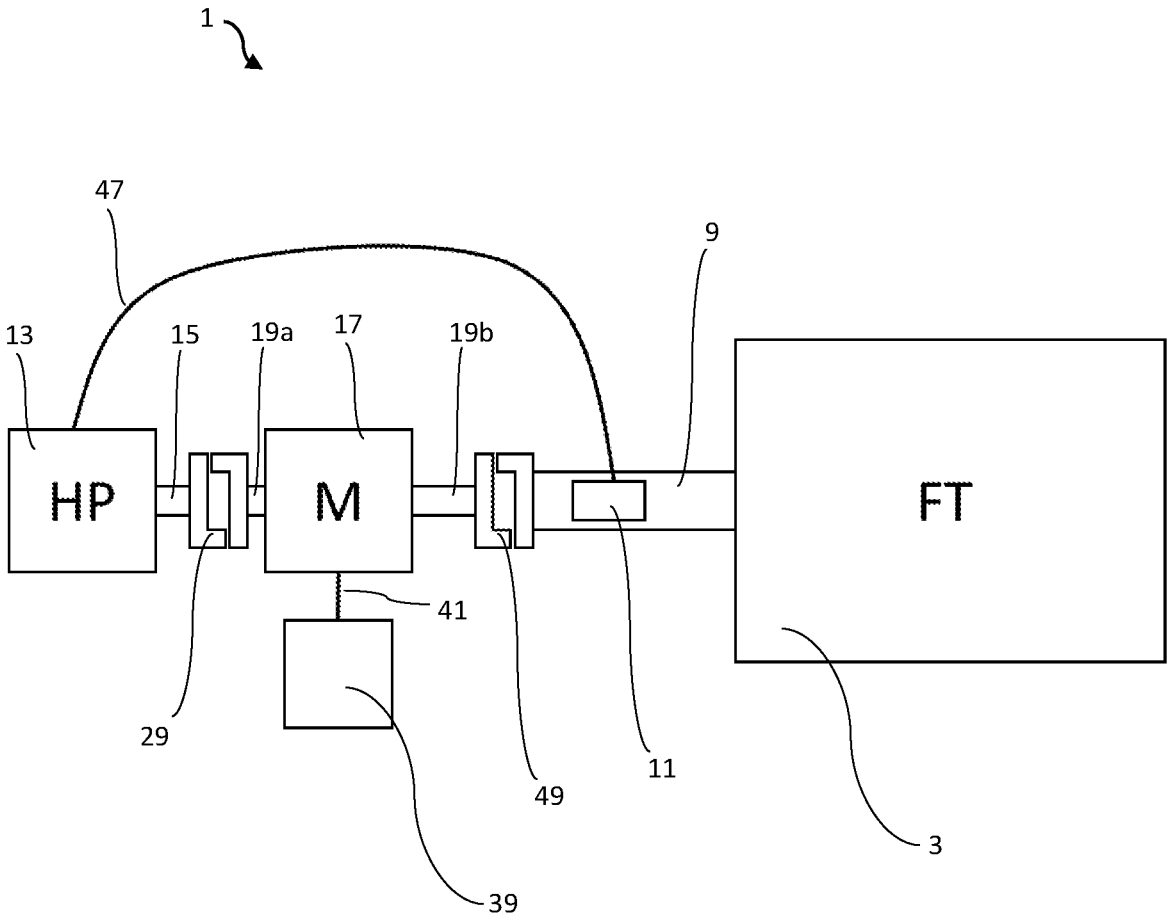
FIG. 4 shows a schematic arrangement of components of a pusher centrifuge according to an embodiment of the invention, and FIG. 5 schematically shows components of a pusher centrifuge according to an embodiment of the invention in a side sectional view.

With reference to FIGS. 1-5, a pusher centrifuge 1 (for a solid-liquid separation of a solid-liquid mixture, e.g., a suspension) includes a rotatable filter drum 3 (in FIGS. 2-4 short: FT) (rotatable about a filter drum longitudinal axis A1) having at least one drum body 5 and a push floor (e.g., piston) 7 arranged in the filter drum 3, wherein the push floor 7 and the at least one drum body 5 can be reciprocated axially relative to each other (in a longitudinal direction of the filter drum 3). The pusher centrifuge 1 also includes a filter drum drive shaft 9 that is non-rotatably (e.g., rigidly and/or fixedly) connected to the filter drum 3 (and, e.g., extends in the longitudinal direction of the filter drum 3) so that the filter drum drive shaft 9 and the filter drum 3 do not rotate with respect to each other. The non-rotatable connection between filter drum drive shaft 9 and filter drum 3 may be implemented by a clutch connection preventing the filter drum drive shaft 9 and the filter drum 3 from rotating relative to each other, but may, e.g., allow the filter drum drive shaft 9 and the filter 3 to slightly move relative to each other in a translatory manner. The pusher centrifuge 1 also includes a hydraulic push mechanism 11 for generating an axial oscillating push force (e.g., an axially reciprocating axial push force). The hydraulic push mechanism 11 is connected to the filter drum 3 in such a way that the axial oscillating push force generated is transmitted to the filter drum 3, thereby causing a relative reciprocating movement between the push floor 7 and the drum body 5. The pusher centrifuge also includes a hydraulic pump 13 (in FIGS. 2-4 short: HP) for generating a hydraulic pressure. The hydraulic pump 13 includes a pump input shaft 15 (with a pump input shaft longitudinal axis A2) and the hydraulic pump 13 is in fluid connection with the hydraulic push mechanism 11 so as to supply the hydraulic pressure to the hydraulic push mechanism 11 in order to operate it for generating the axial oscillating push force. The pusher centrifuge 1 also includes a drive motor 17 (e.g., a single (e.g., main) drive motor) (in FIGS. 2-4 short: M) having an output shaft 19 (with an output shaft longitudinal axis A3) connected to the pump input shaft 15 and the filter drum drive shaft 9 to transmit torque of the drive motor 17 to both the pump input shaft 15 and the filter drum drive shaft 9 (in operation), wherein the output shaft 19 of the drive motor 17 is connected to the pump input shaft 15 in a manner so that the drive motor 17 directly drives the pump input shaft 15. For example, the output shaft 19 of the drive motor 17 is connected to the pump input shaft 15 without an intervening gearbox thereby forming a direct drive (i.e., without an intermediate transmission conversion, e.g., without reduction and/or change in transmission ratio). For example, the output shaft 19 of the drive motor 17 is connected to the pump input shaft 15 so as to be co-axially aligned with each other.

Referring to FIG. 1, the drive motor 17 further includes a motor housing 21 having a motor flange 23 and a lantern (e.g., a can-like and/or cylindrical-like structure) 25. The motor flange 23 is disposed on the same side of the drive motor 17 as the output shaft 19 and is fixedly (e.g., rigidly) connected to one end 25*a* of the lantern 25. The hydraulic pump 13 also includes a pump housing 27 coupled (e.g., rigidly connected) to another end 25*b* of the lantern 25. The lantern 25 extends between the one end 25*a* and the other end 25*b* along an axial direction of the output shaft 19 and may partially surround the output shaft 19 in a direction oriented radially outward from the output shaft 19 (e.g., by means of longitudinal ribs, e.g., by means of longitudinal sections of a circumferential wall interrupted in the circumferential direction of the lantern). That is, the motor housing 21 and the pump housing 27 are connected to each other via (e.g., by means of) the lantern 25. The lantern 25 can be designed as e.g., a turned part (i.e., at least manufactured by turning, e.g., processed using a lathe). The output shaft 19 of the drive motor 17 is connected to the pump input shaft 15 via a clutch 29 (e.g., via a claw clutch). Furthermore, the output shaft 19 of the drive motor 17 is connectable to the filter drum drive shaft 9 by means of a belt 31 (e.g., a V-belt) which can be fitted between the clutch 29 and the motor housing 21 (and/or, the belt 31 can also be fitted between the clutch 29 and the motor flange 23). Referring to FIG. 2, which shows a schematic diagram of a drive assembly connected in the assembled state, the belt 31 is fitted between the clutch 29 and the motor housing 21 (and/or, the belt 31 is fitted between the clutch 29 and the motor flange 23). The drive motor 17 further includes a driving pulley 33 which is non-rotatably (e.g., rigidly and/or fixedly) connected to the output shaft 19 of the drive motor 17 so that the driving pulley 33 and the output shaft 19 are coaxially aligned and the driving pulley 33 and the output shaft 19 do not rotate with respect to each other. The filter drum drive shaft 9 includes a corresponding driven pulley 35 (see FIG. 5). Referring to FIG. 2, the driving pulley 33 and the driven pulley 35 are connectable to each other (and connected in the assembled state) by means of a belt 31 to couple the output shaft 19 of the drive motor 17 to the filter drum drive shaft 9, as shown schematically in FIG. 2. The driving pulley 33 includes a (e.g., substantially cylindrical) projection 37 on a surface of the driving pulley 33 that faces away from the drive motor 17 or faces the hydraulic pump 13 (in relation to a longitudinal direction of the output shaft 19). The projection 37 extends from the surface of the driving pulley 33 in the direction toward the hydraulic pump 13. The projection 37 is at least substantially coaxial with the output shaft 19 and the pump input shaft 15. The projection 37 has a base end (e.g., towards the driving pulley 33) and a tip end (e.g., towards the hydraulic pump) and the pump input shaft 15 has a base end (e.g., towards the hydraulic pump) and a tip end (e.g., towards the driving pulley 33), wherein the clutch 29 is arranged between the respective tip ends of the projection 37 and the pump input shaft 15. Respective clutch members of clutch 29 are non-rotatably connected (e.g., rigidly and/or fixedly mounted) to the respective tip ends of the projection 37 and the pump input shaft 15, to connect the tip ends (and thus the output shaft 19 of the drive motor 17 and the pump input shaft 15 of the hydraulic pump 13) to each other, so that torque is directly transmittable (or is transmitted in operation) from the drive motor 17 to the hydraulic pump 13 (e.g., the torque generated from the drive motor is directly provided to the hydraulic pump (e.g., via the output shaft 19, the driving pulley 33, the projection 37, the clutch 29, and the pump input shaft 15 that are all in coaxial alignment with each other)). In this context, however, the term "without an intervening gearbox" does not exclude the possibility that within the hydraulic pump 13 (e.g., within the pump housing 27) a reduction and/or a change in transmission ratio takes place by means of a pump input transmission, which is, formed in the hydraulic pump 13 (as an integral structural unit) or as a standalone component within the pump housing.

Since the connection "drive motor 17/hydraulic pump 13" is made by a claw clutch, which is mounted directly to the driving pulley 33 as described above (via the projection 37), only the clutch 29 (i.e., the claw clutch) has to be removed to change the belt 31, so that a gap is created, through which an old (e.g., worn) belt can be removed and through which a new belt can be inserted. This may facilitate and accelerate maintenance (e.g., drive maintenance) of the pusher centrifuge 1.

Figure 5:
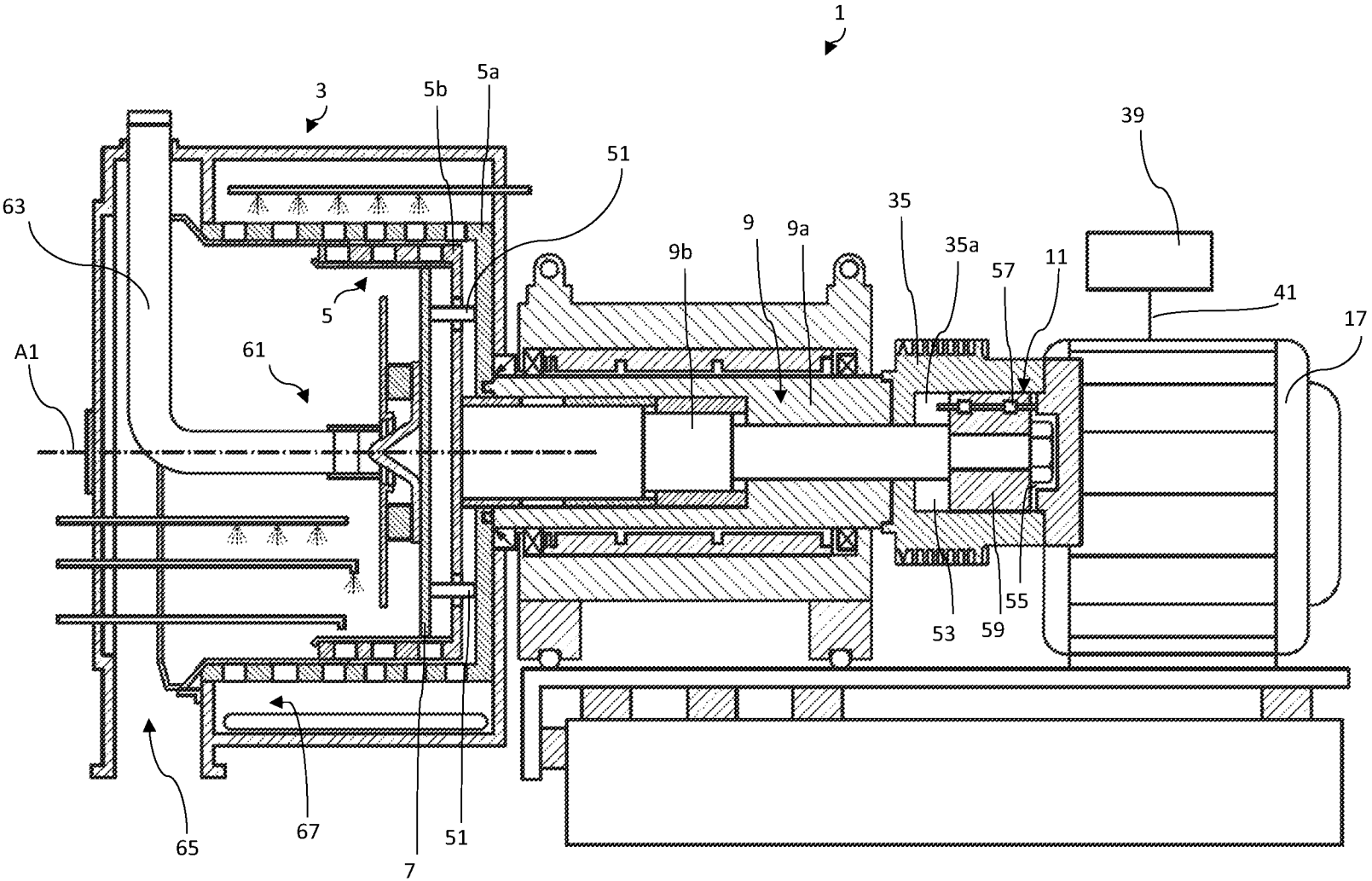

As shown in FIG. 1, the output shaft 19 of the drive motor 17 and the pump input shaft 15 are (e.g., at least essentially) coaxial with each other (see also their longitudinal axes A2, A3), and as shown in FIGS. 1 and 5, the output shaft 19 of the drive motor 17 and the filter drum drive shaft 9 are (e.g., at least substantially) parallel to each other (see also their longitudinal axes A1, A2).

The drive motor 17 is an electric motor, in this case a three-phase asynchronous motor, with an output of 160 kW±20% (e.g., 160 kW±10%, e.g., 160 kW±5%). The electric motor is connected to a control device (not shown in the figures) and electrically connected to a power source 39 by means of a power line 41.

The pusher centrifuge 1 shown in FIG. 1 also includes a hydraulic supply system 43 having e.g., an oil tank 45, to which the hydraulic pump 13 is in fluid connection, in order to be supplied with a hydraulic fluid, e.g., oil. The hydraulic pump 13 is also in fluid connection with the hydraulic push mechanism 11 by means of a fluid line 47, in order to be able to provide (e.g., supply) the hydraulic pressure generated thereby to the hydraulic push mechanism 11.

As shown in FIGS. 1 and 2, the hydraulic pump 13, the clutch 29 and the driving pulley 33 (i.e., in an assembled state also the belt 31) are located on the same side (on the left-hand side in FIG. 1 and on the right-hand side in FIG. 2) of the drive motor 17. According to FIGS. 1 and 2, the following arrangement order (along an axial direction of the output shaft 19 of the drive motor 17) is realized, starting from (e.g., starting with) the drive motor 17: the drive motor 17, the driving pulley 33 (in the assembled state together with the belt 31, see FIG. 2), the clutch 29, and then the hydraulic pump 13.

The embodiment of FIG. 3 is generally configured in the same way as the embodiments of FIGS. 1 and 2, so that only the differences are described below. Referring to FIG. 3, the drive motor 17 includes a first output shaft 19*a* and a second output shaft 19*b* that, starting from the drive motor 17, extend coaxially with respect to each other on opposing (or opposite) sides (i.e., according to FIG. 3 on a left and on a right side) of the drive motor 17. The first output shaft 19*a* is, analogous to the embodiment of FIGS. 1 and 2, connected to the pump input shaft 15 (via the clutch 29) in a way without an intervening gearbox (e.g., without an intermediate transmission conversion, e.g., without reduction and/or change in transmission ratio), thereby forming a direct drive, and the second output shaft 19*b* is, analogous to the embodiment of FIGS. 1 and 2, connected to the filter drum drive shaft 9 (by means of the belt 31 (e.g., the V-belt) connecting the driving pulley 33 of the drive motor 17 and the driven pulley 35 of the filter drum drive shaft 9).

As shown in FIG. 3, the hydraulic pump 13 and the clutch 29 are both located on a first side (in FIG. 3 on the right side) of the drive motor 17, and the driving pulley 33 and the belt 31 are both located on a second side (in FIG. 3 on the left side) of the drive motor 17, which is opposite to the first side of the drive motor 17. According to FIG. 3, the following arrangement order (along an axial direction of the pump input shaft 15) is realized, starting from (e.g., starting with) the hydraulic pump 13: the hydraulic pump 13, the clutch 29, the drive motor 17 (or the first output shaft 19*a*, the drive motor 17, the second output shaft 19*b*), and then the driving pulley 33 together with the belt 31.

Referring to FIG. 4, another embodiment is shown, which is generally configured like the embodiment of FIG. 3, so that in the following only the differences are described. Referring to FIG. 4, the second output shaft 19*b* of the drive motor 17 is connected to the filter drum drive shaft 9 in a way so as to form a direct drive transmission. The second output shaft 19*b* of the drive motor 17 is connected to the filter drum drive shaft 9 in co-axial alignment. The second output shaft 19*b* of the drive motor 17 is connected to the filter drum drive shaft 9 without an intervening gearbox (e.g., without an intermediate transmission conversion, e.g., without reduction and/or change in transmission ratio). The first output shaft 19*a* of the drive motor 17 is connected to the pump input shaft 15 as described above via a clutch 29, and the second output shaft 19*b* of the drive motor 17 is connected to the filter drum drive shaft 9 via a drive shaft clutch 49. According to FIG. 4, the following arrangement order (along an axial direction of the pump input shaft 15) is realized starting from (e.g., starting with) the hydraulic pump 13: the hydraulic pump 13, the clutch 29, the drive motor 17 (or the first output shaft 19*a*, the drive motor 17, the second output shaft 19*b*), the drive shaft clutch 49, and the filter drum drive shaft 9.

With reference to FIG. 5, the filter drum drive shaft 9 includes: an outer filter drum drive shaft 9*a*, which is formed as a hollow shaft, and an inner filter drum drive shaft 9*b*, which is mounted in the outer filter drum drive shaft 9*a* so as to be axially movable and which is connected to the filter drum 3 and the hydraulic push mechanism 11 in such a way (or operatively connected in such a way) that the axial oscillating push force is transmitted from the hydraulic push mechanism 11 to the filter drum 3 (in operation) to cause the relative reciprocating movement between the push floor 7 and the drum body 5.

The pusher centrifuge 1 with the previously described filter drum drive shaft 9 (of FIG. 5) is configured as a two-stage pusher centrifuge 1 having an outer first drum body 5*a* and an inner second drum body 5*b*. The pusher centrifuge 1 accordingly includes: the rotatable filter drum 3 with the outer first drum body 5*a* and the inner second drum body 5*b* and with the push floor 7, which is arranged inside the filter drum 3 in the inner second drum body 5*b* and is fixedly connected to the outer first drum body 5*a*, the inner second drum body 5*b* being capable of being reciprocated relative to the push floor 7 and the outer first drum body 5*a* (in a longitudinal direction of the filter drum 3) (caused by means of the axial oscillating push force).

The push floor 7 is non-rotatably connected to the outer first drum body 5*a* via rods 51 extending axially through the inner second drum body 5*b*. The inner filter drum drive shaft 9*b* is non-rotatably (e.g., rigidly and/or fixedly) connected to the inner second drum body 5*b*. The outer filter drum drive shaft 9*a* is non-rotatably (e.g., rigidly and/or fixedly) connected at one (longitudinal) end thereof to the outer first drum body 5*a* and at another opposite (longitudinal) end thereof to the driven pulley 35. The hydraulic push mechanism 11 is configured (e.g., installed) in (e.g., inside) the driven pulley 35. For this purpose, the driven pulley 35 includes an accommodation space 35*a* for accommodating or receiving the hydraulic push mechanism 11. The hydraulic push mechanism 11 includes: a piston member 59 which fluid-tightly divides the accommodation space 35*a* into a first hydraulic pressure chamber 53 and a second hydraulic pressure chamber 55 and which is connected to the inner filter drum drive shaft 9*b* in a non-rotatable and axially fixed manner, a pilot control slider 57, and a main control slider (not shown in the Figures) which is controlled by means of the pilot control slider 57 to assume either a first position state or a second position state. A fluid guide (not shown in the Figures) is formed in the piston member 59, which is connected to the fluid line 47 so as to receive a hydraulic pressure from the hydraulic pump 13, and which is configured so that when the main control slider is in the first position state, the hydraulic pressure is supplied to the first hydraulic pressure chamber 53 (and a hydraulic pressure in the second hydraulic pressure chamber 55 is discharged) and, when the main control slide is in the second position state, the hydraulic pressure is supplied to the second hydraulic pressure chamber 55 (and a hydraulic pressure in the first hydraulic pressure chamber 53 is discharged). When the hydraulic pressure is supplied to the first hydraulic pressure chamber 53, an axial push force generated by the hydraulic pressure and acting on the piston 59 causes it (together with the inner filter drum drive shaft 9*b* and the inner second drum body 5*b*) to move axially toward the second hydraulic pressure chamber 55 (in a longitudinal direction of the filter drum drive shaft 9, to the right as shown in FIG. 5). When the hydraulic pressure is supplied to the second hydraulic pressure chamber 55, an axial push force generated by the hydraulic pressure and acting on the piston 59 causes it (together with the inner filter drum drive shaft 9*b* and the inner second drum body 5*b*) to move axially towards the first hydraulic pressure chamber 53 (in a longitudinal direction of the filter drum drive shaft 9, to the left as shown in FIG. 5). The pilot control slider 57 is configured to control the main control slider such that it alternately assumes the first position state and the second position state by alternately axially striking the opposite end walls so that the axial push force generated acts in an oscillating manner on the piston 59 to cause the relative reciprocating movement between the push floor 7 and the drum body 5, in the present case the inner second drum body 5*b*.

The pusher centrifuge 1 may further include: a feeding device 61 having a feeding line 63, via which a solid-liquid mixture to be filtered (e.g., a suspension to be filtered) can be fed into the inner second drum body 5*b* and the outer first drum body 5*a* (and thus into the filter drum 3), a solid discharge device 65, by means of which a screened or filtered solid portion of the solid-liquid mixture can be discharged from the filter drum 3, and a liquid discharge device 67, by means of which the liquid portion of the solid-liquid mixture can be discharged from the filter drum 3.

Although the invention has been described by means of embodiments, the invention is not limited to these embodiments. Instead, the skilled person will also consider alternatives and modifications as covered by the invention, provided that they are within the scope of protection defined by the claims.

LIST OF REFERENCE SIGNS

1: pusher centrifuge
3: filter drum
5: drum body
5*a*: outer first drum body
5*b*: inner second drum body
7: push floor (e.g., piston)
9: filter drum drive shaft
9*a*: outer filter drum drive shaft
9*b*: inner filter drum drive shaft
11: hydraulic push mechanism
13: hydraulic pump
15: pump input shaft
17: drive motor
19: output shaft of drive motor
19*a*: first output shaft of drive motor
19*b*: second output shaft of drive motor
21: motor housing
23: motor flange
25: lantern
25*a*: end of the lantern
25*b*: other end of the lantern
27: pump housing
29: clutch
31: belt
33: driving belt pulley
35: driven belt pulley
35*a*: accommodation space

37: projection
39: power source
41: power line
43: hydraulic supply system
45: oil tank
47: fluid line
49: drive shaft clutch
51: rod
53: first hydraulic pressure chamber
55: second hydraulic pressure chamber
57: pilot control slider
59: piston member
61: feeding device
63: feeding line
65: solid discharge device
67: liquid discharge device
A1: filter drum longitudinal axis
A2: pump input shaft longitudinal axis
A3: output shaft longitudinal axis

The invention claimed is:

1. A pusher centrifuge, comprising:

a rotatable filter drum having at least one drum body and a push floor, wherein the at least one drum body and the push floor are arranged in the filter drum and are configured to be reciprocated axially relative to one another;

a filter drum drive shaft that is non-rotatably connected to the filter drum;

a hydraulic push mechanism for generating an axial oscillating push force, wherein the hydraulic push mechanism is connected to the filter drum in such a manner that the axial oscillating push force generated thereby is transmitted to the filter drum, thereby causing the relative reciprocating movement between the push floor and the at least one drum body;

a hydraulic pump for generating a hydraulic pressure, wherein the hydraulic pump comprises a pump input shaft and wherein the hydraulic pump is in fluid connection with the hydraulic push mechanism so as to supply hydraulic pressure to the hydraulic push mechanism to operate the same to generate the axial oscillating push force; and a drive motor comprising at least one output shaft connected to the pump input shaft and the filter drum drive shaft for transmitting a torque of the drive motor to both the pump input shaft and the filter drum drive shaft, wherein the at least one output shaft of the drive motor is connected to the pump input shaft to form a direct drive transmission, wherein the at least one output shaft of the drive motor comprises a first output shaft and a second output shaft extending on opposing sides of the drive motor, starting from the drive motor, and wherein the first output shaft is connected to the pump input shaft without intervening transmission conversion elements to form the direct drive transmission, and the second output shaft is connected to the filter drum drive shaft.

2. The pusher centrifuge of claim 1, wherein the first output shaft of the drive motor is connected to the pump input shaft via a clutch.

3. The pusher centrifuge of claim 2, wherein the second output shaft of the drive motor is connected to the filter drum drive shaft by means of a belt, further comprising:

a driving pulley disposed on the second output shaft of the drive motor, a driving pulley disposed on the filter drum drive shaft, wherein the driving pulley and the driven pulley are associated with the belt.

4. The pusher centrifuge of claim 2, wherein the second output shaft of the drive motor is connected to the filter drum drive shaft via a second clutch.

5. The pusher centrifuge of claim 1, wherein the at least one output shaft of the drive motor is connected to the pump input shaft via a clutch.

6. The pusher centrifuge of claim 5, wherein the clutch is a non-releasable clutch.

7. The pusher centrifuge of claim 5, wherein the clutch is a safety clutch or a safety slip clutch.

8. The pusher centrifuge of claim 5, wherein the clutch is a safety clutch with overload protection having a predetermined breaking point.

9. The pusher centrifuge of claim 5, wherein the clutch is a flexible clutch or a flexible claw clutch.

10. The pusher centrifuge of claim 1, wherein the at least one output shaft of the drive motor is connected to the filter drum drive shaft by a belt.

11. The pusher centrifuge of claim 10, further comprising:

a clutch; and a driving pulley disposed on the at least one output shaft of the drive motor, wherein the driving pulley is associated with the belt, wherein the hydraulic pump, the clutch, and the drive pulley are disposed on a same side of the drive motor.

12. The pusher centrifuge of claim 11, wherein starting from the drive motor, the hydraulic pump, the clutch, and the driving pulley are arranged in the order of the driving pulley, the clutch, and the hydraulic pump along an axial direction of the output shaft of the drive motor.

13. The pusher centrifuge of claim 1, wherein the at least one output shaft of the drive motor and the pump input shaft are at least substantially coaxial with each other.

14. The pusher centrifuge of claim 13, wherein the at least one output shaft of the drive motor and the pump input shaft are connected so that a rotational axis of the at least one output shaft and a rotational axis of the pump input shaft are in coaxial alignment with each other.

15. The pusher centrifuge of claim 1, wherein the at least one output shaft of the drive motor and the filter drum drive shaft are at least substantially parallel to each other.

16. The pusher centrifuge of claim 1, wherein the filter drum drive shaft includes:

an outer filter drum drive shaft formed as a hollow shaft; and an inner filter drum drive shaft that is axially movably supported in the outer filter drum drive shaft, wherein the inner filter drum drive shaft is connected to the filter drum and the hydraulic push mechanism in such a manner that the axial oscillating push force is transmitted from the hydraulic push mechanism to the filter drum to cause the relative reciprocating movement between the piston and the at least one drum body.

17. A pusher centrifuge, comprising:

a rotatable filter drum having at least one drum body and a push floor, wherein the at least one drum body and the push floor are arranged in the filter drum and are configured to be reciprocated axially relative to one another;

a filter drum drive shaft that is non-rotatably connected to the filter drum;

a hydraulic push mechanism for generating an axial oscillating push force, wherein the hydraulic push mechanism is connected to the filter drum in such a manner that the axial oscillating push force generated thereby is transmitted to the filter drum, thereby causing the relative reciprocating movement between the push floor and the at least one drum body;

a hydraulic pump for generating a hydraulic pressure, wherein the hydraulic pump comprises a pump input shaft and wherein the hydraulic pump is in fluid connection with the hydraulic push mechanism so as to supply hydraulic pressure to the hydraulic push mechanism to operate the same to generate the axial oscillating push force; and a drive motor comprising at least one output shaft connected to the pump input shaft and the filter drum drive shaft for transmitting a torque of the drive motor to both the pump input shaft and the filter drum drive shaft, wherein the at least one output shaft of the drive motor is connected to the pump input shaft to form a direct drive transmission, wherein the drive motor further comprises a driving pulley that is non-rotatably connected to the at least one output shaft of the drive motor, and wherein the filter drum drive shaft further includes a driven pulley, wherein the driving pulley and the driven pulley are connected by means of a belt to connect the at least one output shaft of the drive motor to the filter drum drive shaft.

18. The pusher centrifuge of claim 17, wherein the at least one output shaft of the drive motor and the pump input shaft are at least substantially coaxial with each other.

19. The pusher centrifuge of claim 17, wherein the at least one output shaft of the drive motor and the filter drum drive shaft are at least substantially parallel to each other.

20. The pusher centrifuge of claim 17, wherein the filter drum drive shaft includes:

an outer filter drum drive shaft formed as a hollow shaft; and an inner filter drum drive shaft that is axially movably supported in the outer filter drum drive shaft, wherein the inner filter drum drive shaft is connected to the filter drum and the hydraulic push mechanism in such a manner that the axial oscillating push force is transmitted from the hydraulic push mechanism to the filter drum to cause the relative reciprocating movement between the push floor and the at least one drum body.

* * * * *